US010035240B2

(12) United States Patent
Buser

(10) Patent No.: US 10,035,240 B2
(45) Date of Patent: Jul. 31, 2018

(54) ADAPTIVE DUST SHIELD DEVICE HAVING ZERO STANDOFF CAPABILITY

(71) Applicant: John P. Buser, San Diego, CA (US)

(72) Inventor: John P. Buser, San Diego, CA (US)

(73) Assignee: SHAVE AWAY EUROPE, INC., San Diego, CA (US)

( * ) Notice: Subject to any disclaimer, the term of this patent is extended or adjusted under 35 U.S.C. 154(b) by 231 days.

(21) Appl. No.: 14/970,438

(22) Filed: Dec. 15, 2015

(65) Prior Publication Data

US 2017/0165808 A1 Jun. 15, 2017

(51) Int. Cl.
*B24B 23/02* (2006.01)
*B24B 55/10* (2006.01)

(52) U.S. Cl.
CPC ..... *B24B 55/102* (2013.01)

(58) Field of Classification Search
CPC ..... B24B 23/02; B24B 55/102; B24B 23/028; B24B 55/10
USPC ..... 451/456, 454, 451, 359
See application file for complete search history.

(56) References Cited

U.S. PATENT DOCUMENTS 5,125,190 A * 6/1992 Buser ..... B24B 55/102 451/359
5,609,516 A * 3/1997 Courson ..... B24B 23/028 451/359
8,282,447 B1 * 10/2012 Buser ..... B24B 55/102 451/451
8,702,478 B2 * 4/2014 Loveless ..... B24B 23/028 24/681
9,289,879 B2 * 3/2016 Copeland ..... B24B 23/028
2009/0186559 A1 * 7/2009 Loveless ..... B24B 55/10 451/28

* cited by examiner

*Primary Examiner* — Robert Rose
(74) *Attorney, Agent, or Firm* — Steins & Associates, P.C.

(57) ABSTRACT

An Adaptive Dust Shield Device having Zero Standoff Capability for rotary grinders having a bearing housing and an axial groove around the bearing housing. The dust shield has a cover molded from a single shot. The cover has a plurality of upstanding flexible fingers, in multiples of four, which extend upward from the cover. A door is formed in one side of the dust shield cover to allow the user to use the dust shield in zero clearance situations. The flexible fingers have a defined width and are separated apart from each other by a space between each one. The width of the space is less than the defined width of the flexible fingers. A stretchable fitting ring fits onto the bearing housing of the grinder and under the flexible fingers. The flexible fingers are secured onto the stretchable fitting ring by a securing fastener. There are a plurality of vent holes formed in the top wall that are selectively pluggable with plug elements.

18 Claims, 6 Drawing Sheets

ADAPTIVE DUST SHIELD DEVICE HAVING ZERO STANDOFF CAPABILITY

This application is filed within one year of, and claims priority to Provisional Application Ser. No. 62/092,119, filed Dec. 15, 2014.

BACKGROUND OF THE INVENTION

1. Field of the Invention

This invention relates generally to power hand tools and, more specifically, to an Adaptive Dust Shield Device having Zero Standoff Capability.

2. Description of Related Art

Rotary grinders and similar rotary power tools are used extensively in industry. More specifically, angle type grinders/sanders having grinding discs or pads, are used for grinding concrete, fiberglass, wood, steel, removing asbestos, and body filler in automobile shops. Such grinders/sanders are also used for making boats and similar products. In use, these grinders create large quantities of dust that are both a fire hazard and a health hazard. Wood dust, for example, can be very explosive over a wide range of concentrations and is a known fire hazard. Hot metal grindings are particularly dangerous as fire starters. Both wood dust and metal filings, as well as asbestos particles, fiberglass and body filler particles, create known health hazards to users of the grinders and to others in the immediate environment. It is known that concrete dust, as typically generated in great quantities from grinding concrete, is a principal cause of pulmonary silicosis.

Grinder discs and pads often rotate in excess of 7,000 revolutions per minute (RPM). Grinding pads that use a sponge type backing material create a hazard where parts or particles from the backing material break off and are shot from the rotating disc tangently at a high rate of speed. It is often necessary to use a rotary grinder to grind into corners or against surfaces that have side edges that can cause particles of the foam backing material to break off from the high speed rotating disc and hit the operator or other persons or equipment in the immediate area.

A dust shield described in U.S. Pat. No. 5,125,190 approached this problem and solved it to some extent. It has an upstanding attachment collar [reference character 16 of U.S. Pat. No. 5,125,190] which had a diameter chosen to fit onto the bearing housing [reference character 38 of U.S. Pat. No. 5,125,190] of a variety of different grinders. Grinders from varying manufacturers have different diameters for their respective bearing housing. Typical diameters of bearing housings range from one and one-half inch to three inches, and therefore a one-size attachment collar on the dust shield would not accommodate the varying bearing housings. Consequently, several different models of the dust shield, each having different collar diameters, had to be manufactured for the various make grinders or requires an adapted. This, of course, increases manufacturing costs and adds to inventory of a supplier and end-user since most end-users have more than one grinder and more than one make.

Without the adapter, the retailer generally must carry up to 40 SKUs (stock keeping units) to cover all the grinders made. With the adapter, the retailer will need only 6 stocking units, one for each of the major disc diameters of 2, 3, 5, 6, 7 and 8 inches. Space in a retail store is very valuable, and therefore the reduction of SKUs adds value to the adapter because it can reduce the amount of space needed to provide a line of dust shields that can fit all grinders.

Additionally, the grinding surface of different brands of grinders with different grinding disks varies in distance from the bearing housing of the grinder where the dust shield is attached. The dust shield of U.S. Pat. No. 5,125,190 was not readily capable of a distance adjustment to bring the grinding surface down to where it can be of effective use or, in some cases, any use at all. The collar (reference character 16 of U.S. Pat. No. 5,125,190) had to be individually and carefully sanded down such that its lower edge (reference character 35 of U.S. Pat. No. 5,125,190) was accordingly raised thereby bringing the grinding surface out to point of use. Cutting the skirt, improper sanding, or improper measurements would in essence ruin the dust shield and be a waste of time and money.

Additionally, the plastics formulation used in the manufacture of the adaptive dust shield is such that, if cutting the adaptive dust shield is necessary, it can easily be cut with ordinary household scissors without ruining the adaptive dust shield in its entirety. The formulation provides for greater flexibility, thereby eliminating much of the need to make distance adjustments of the fitting ring into and away from the bearing housing and into and away on the upstanding fingers.

FIG. 1 is an exploded perspective view of the adaptive dust shield device of U.S. Pat. No. 8,282,447 100 and a conventional angle grinder 60. The dust shield 100 attaches to the bearing housing 68 of the grinder 60. In order to accommodate the widest variety of grinder 60 models, the dust shield 100 may be used with a split fitting ring 110, that slips over the bearing housing 68 before the ring formed from the upstanding fingers 178 are slipped thereover. The securing fastener 88 is then attached to encircle the upstanding fingers 178, fitting ring 110, and bearing housing 68, and tightened around the combination. This securely holds the dust shield device 100 to the grinder. An external hose 82 from the user's vacuum system attaches to the exit opening 86 of the exhaust port 80. The air vents 75 and angled slots 184 allow air to flow in to the internal chamber under the cover 170 in order to create sufficient airflow through the system and into the external vacuum system through the exhaust port 80. It also prevents the creation of too much suction on the bottom of the cover 170, which tends to make the cover want to stick to the surface that the user is working above.

Through experience with the dust shield 100, it has been noticed that in certain circumstances, it is necessary to cut, grind or polish in "zero clearance" or "zero standoff" conditions. An example of a zero clearance condition would be where the user needs to grind a floor up to where it meets a wall or other vertical obstruction. In such a case, the outer periphery of the grinding wheel needs to be exposed, because otherwise the dust shield 100 would prevent the user from reaching all the way to the wall/vertical obstruction. Historically, the user would simply remove the dust shield 100 from the grinder while doing any zero clearance sections. As should be apparent, removal of the dust shield for any reason during operation is dangerous and unhealthy.

What is needed, then, is an adaptive dust shield for angle grinders that can accommodate grinding in zero clearance situations without the need to remove the dust shield from the grinder.

SUMMARY OF THE INVENTION

In light of the aforementioned problems associated with the prior devices and systems, it is an object of the present invention to provide an Adaptive Dust Shield Device having Zero Standoff Capability. The adaptive dust shield is generally for rotary grinders having a bearing housing and an axial groove around the bearing housing. The dust shield should be formed in a "single shot" molding process from durable material such as vinyl or the like, with a wall thickness substantially thicker than were the dust shield covers of the prior devices. The adaptive dust shield has a cover with a defined diameter and may have an upstanding collar with a Width-X on top of the cover where Width-X is substantially less than said defined diameter. A plurality of upstanding flexible fingers with a Height-H and in multiples of four extend upward from the top of and around the upstanding collar. These plurality of upstanding flexible fingers have a Width-W2 and are separated apart from each other defining a space between each one of these plurality of upstanding flexible fingers wherein this space has a Width-W1 and wherein Width-W1 is less than Width-W2. A stretchable, rubber-like fitting ring is adapted to be stretched if necessary and to fit onto the bearing housing of the grinder. The outside diameter of the fitting ring is adapted to fit into the plurality of upstanding flexible fingers. Being flexible, the plurality of upstanding flexible fingers may flex inward, toward the fitting ring, or outward, away and around the outside diameter of the fitting ring, and be secured onto the fitting ring by a suitable securing fastener. Tightening the securing fastener over the upstanding flexible fingers compresses them into the fitting ring and the fitting ring into the groove of the bearing housing of the grinder. There should be a door element formed in at least one side of the dust shield cover. The door element should be able to be opened when the user wishes to expose a portion of the outer periphery of the rotating tool (blade or grinding wheel, etc.) so that the user can keep the dust shield on the grinder when grinding in zero clearance situations. The door element should be made as an integral part of the dust shield cover when manufactured, with a "living hinge" formed from hinge elements molded to interconnect the door element with the base of the dust shield cover. The dust shield should also be provided with a peg that can be used to retain the door element in the opened position, so that the user does not need to use his/her hands to keep the door element open.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Adaptive Dust Shield Device having Zero Standoff Capability.

Figure 1:
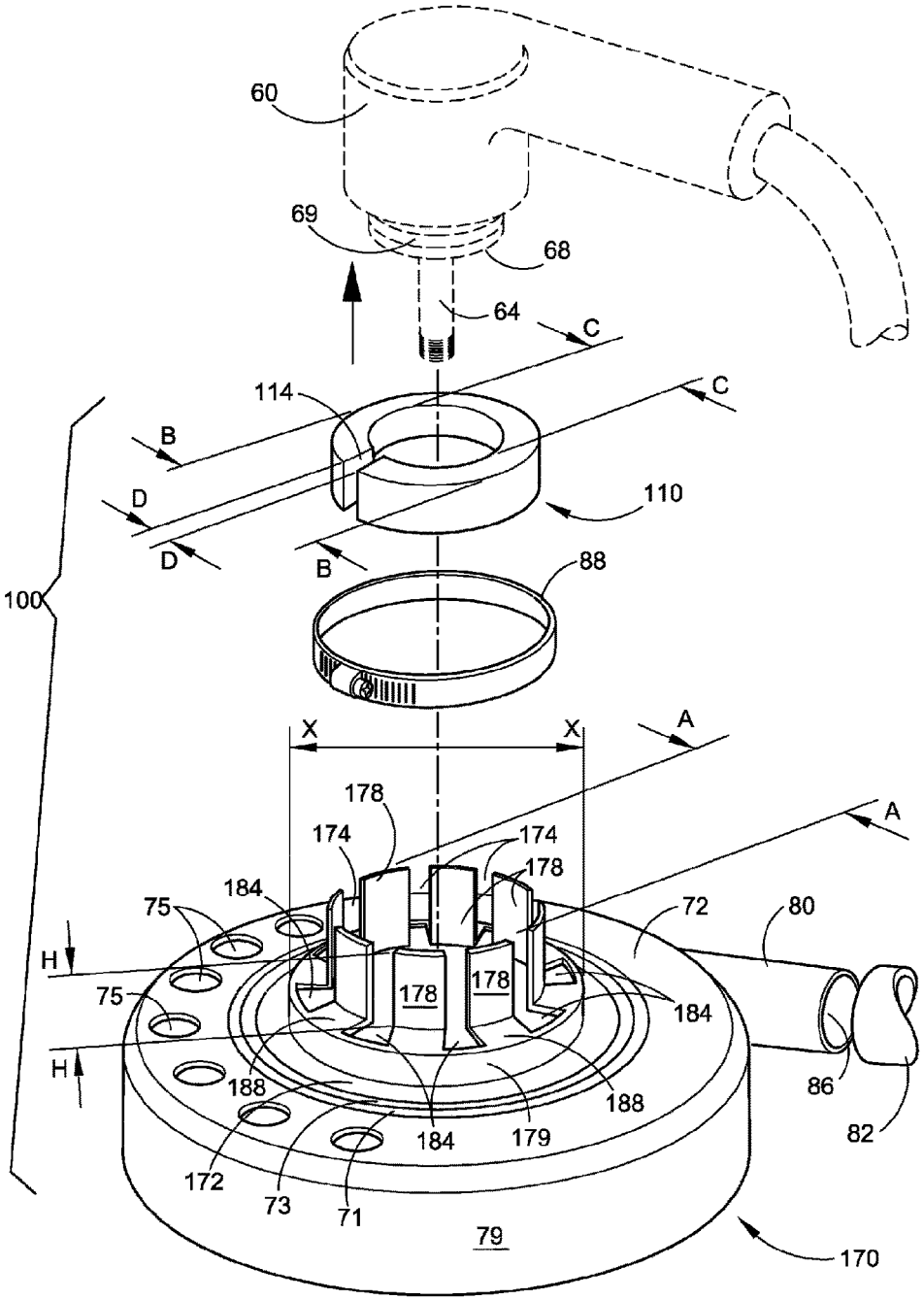
FIG. 1 PRIOR ART
FIG. 1 is an exploded perspective view of the adaptive dust shield device of U.S. Pat. No. 8,282,447 and a conventional angle grinder.
Figure 2:
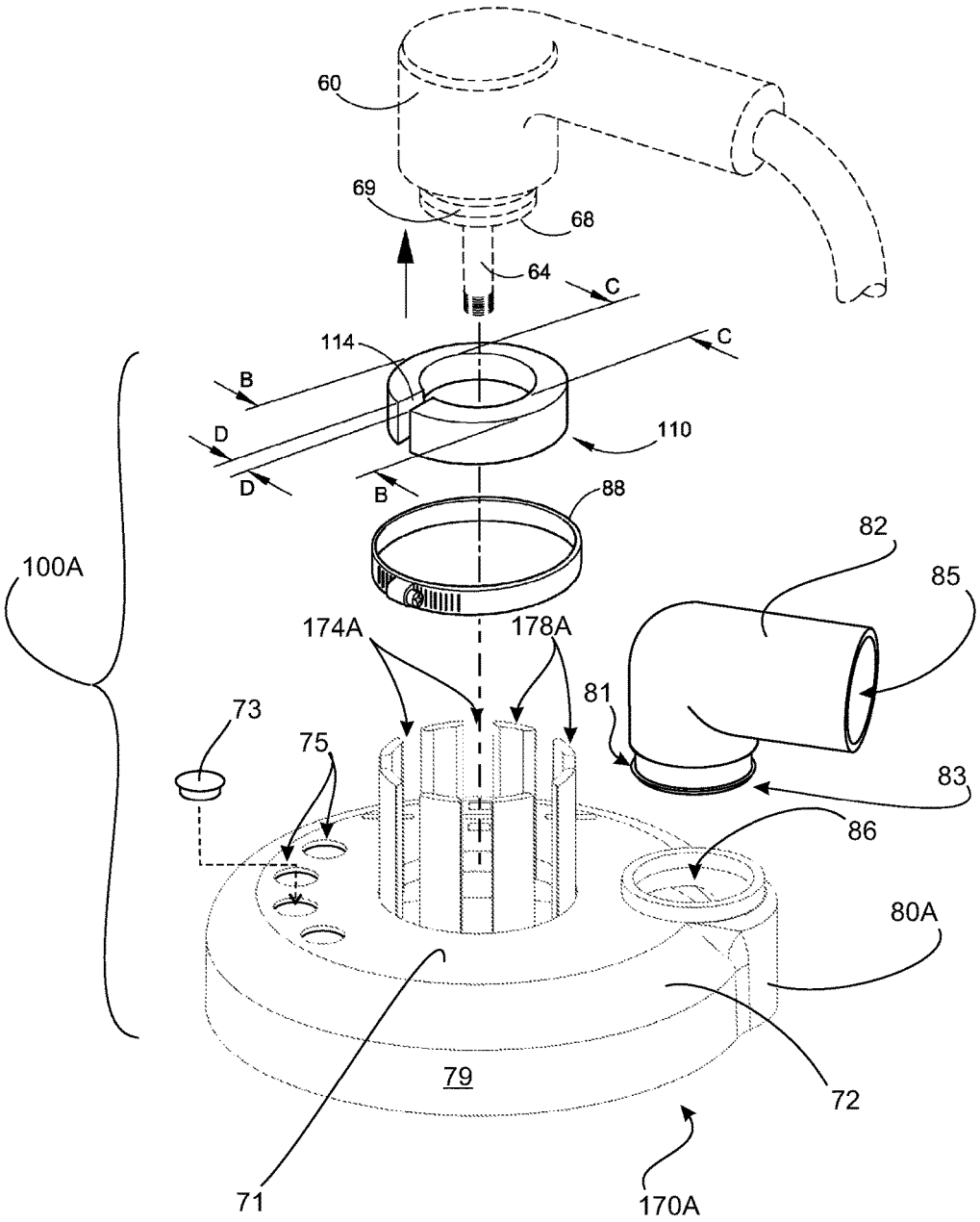
FIG. 2 is an exploded perspective view of a preferred embodiment of the adaptive dust shield having zero standoff capability of the present invention and a conventional angle grinder.

The present invention can best be understood by initial consideration of FIG. 2.[1] FIG. 2 is an exploded perspective view of a preferred embodiment of the adaptive dust shield having zero standoff capability of the present invention 100A and a conventional angle grinder 60. As with the shield [100], a fitting ring 110 and securing fastener 88 are a part of the kit for the purpose described in more detail below.

[1]As used throughout this disclosure, element numbers enclosed in square brackets [ ] indicates that the referenced element is not shown in the instant drawing figure, but rather is displayed elsewhere in another drawing figure.

While shield [100] was formed with numerous air vents [75], as well as angled slots [184] in order to provide supply air to the vacuum source, in the instant design 100A, there are likely to be fewer air vents 75 and no angled slots [184] formed in the upper portion 72 of cover 170A. This reduction in potential airflow through the device 100A is enabled because the cover 170A has a door formed in it that can be opened and closed, as will be depicted and described below. When that door is in the open position, quite a bit of air will flow in through the opening [43] and past the grinder wheel. If there were as many air vents 75 as in the prior device [100], there would be the risk that insufficient vacuum (and therefore dust capturing) would be present within the cover 170A. Also, the hose adapter 82 may include a relief vent that will allow air into the vacuum hose (downstream of the dust shield 100A).

In this simplified design (i.e. for simplification of the molding process), there is preferably a single sloped portion 72 interconnecting the upper portion 72 with the skirt 79.

Experience has shown that multiples of 4 such upstanding fingers 178A provide for better results because they can adapt easily to both round bearing housings 68 and square bearing housings alike [not illustrated]

Width-A of applicant's adaptive dust shield 100A is generally set to be close to the largest diameter of the bearing housings of the largest grinders. As such, Width-A [upstanding flexible fingers 178A] of applicant's adaptive dust shield 100A should generally range from approximately 2.00-inches to about 3.00-inches. It can thereby (with application of the stretchable fitting ring 110, if necessary) accommodate virtually all diameter sizes of bearing housing and not cause a pinch-off of the fingers or sliding off of the dust shield. Use of the stretchable fitting ring 110, where necessary, builds up small diameter bearing housings to allow the upstanding flexible fingers to compress and secure, with application of the securing member, the dust shield to virtually any grinder.

The inside diameter [Width-C] of the fitting ring 110 should be roughly the same as the smallest commercially available bearing housing 68 (i.e., from approximately 1.50 inches to approximately 2.00 inches). The fitting ring 110 should be made of a stretchable material [like a rubber band] or a flexible material such that it will fit over bearing housing 68 diameters which are greater than the inside diameter of the fitting ring 110.

The most suitable materials for the fitting ring 110, for the functions above described of stretching and flexing and compressing, include, but are not limited to, any flexible vinyl or rubber compositions of such flexibility to permit an expansion or stretching of the fitting ring 110, a cutting of the fitting ring 110, and a compression of the fitting ring when the clamp 88 is tightened around the upstanding fingers 178A to permit the upstanding fingers to compress into and "grip" the fitting ring 110 and for the fitting ring 110 to compress around the bearing housing 68 and, very importantly, into the groove 69 in the bearing housing 68 of most conventional grinders 60.

This gripping, compression by the upstanding fingers 178A into the fitting ring 110 and of the fitting ring 110 into the groove 69 creates a clearly defined "mechanical connection" among all the components and prevents any rotational or vertical movement of the cover 170A around the fitting ring 110 or around the bearing housing 68. The groove 69 of typical grinders 60 generally is an annular groove perpendicular to the axis of rotation or may be a slot-type groove which is parallel to the axis of rotation. In either case, the mechanical connection as described above is created.

In situations where the inside diameter of the fitting ring 110 is greater than the diameter of the bearing housing 68, the fitting ring 110 easily slips thereover. The upstanding fingers 178A of the cover 170A are spread if necessary and placed around the outside diameter of the fitting ring 110 and then released thereon. A suitable securing fastener 88, such as a hose clamp, is placed around the outside diameter of the upstanding fingers 178. It should be understood that the securing fastener 88 may be placed loosely around the upstanding fingers 178A before placement of the upstanding fingers 178A around the outside diameter of the fitting ring 110 to facilitate the process.

In situations where the inside diameter of the fitting ring 110 is considerably smaller than the outside diameter of the bearing housing 68, because of the composition of the fitting ring 110, a user may stretch the fitting ring 110 to thereby 10 permit that person to spread out the two ends of the fitting ring 110 and by so doing to increase the size of its inside diameter. The user then places the fitting ring 110 over and onto the bearing housing 68 and releases the spread ends causing them to retract onto the bearing housing. The steps of placement of cover 170A and securing fastener 88, as described above, follow.

Additionally, in situations where the outside diameter of the bearing housing 68 is considerably smaller than the inside diameter of the fitting ring 110, the user may merely cut off one or more segments of the fitting ring 110 until a suitably sized inside diameter for the fitting ring 110 is established. In cases where the outside diameter of the bearing housing 68 is extremely small, a second fitting ring 110 may be placed and secured over the first fitting ring. The clamping, compressing, and squeezing as described above caused by tightening of the securing fastener 88 establish a secure mechanical connection between all these parts.

The exhaust port 80A in this design is somewhat different from the port [80] of the prior device. It is oriented so that its axis is parallel to the axis of the skirt 79 and upstanding fingers 178A so that the cover 170A can be molded in a single step. The tangentially-oriented port [80] makes such a single shot molding process virtually impossible. The ability to manufacture the cover 170A in a single shot molding process substantially reduces the manufacturing cost of the cover 170A. Re-designing the port 80A allows the cover 170A to be formed with a simple A-B mold (one that opens and closes and shoots out a part). If molded with the side mounted exhaust port [80], a slide would be required. When the mold is closed, the slide (which is actuated by hydraulics or a solenoid) is forced into place. This allows the plastic to form the exhaust port. The slide is then withdrawn and then the two parts of the tool (mold) are separated and the part is ejected. This adds great cost to the manufacture of the tool and also presents a hazard when molding. If for any reason the slide doesn't withdraw at the proper time and the mold opens with it in place, the mold will almost certainly be badly damaged.

Because the exit opening 86 is oriented straight up (i.e. parallel to the axis of the arbor 64), an optional hose adapter 82 may be provided to interconnect the exhaust port 80A with the vacuum source (not shown). The hose adapter 82 is selected from a group of adapters 82 that convert the diameter of the exit opening 86 to the proper size for the user's vacuum hose. The hose adapter 82 may be angled, as shown, or it may be straight. The barb 81 at the edge of the inlet 83 operates to retain the adapter 82 in the exit opening, as well as being a swivel that allows the outlet 85 to pivot in relation to the cover 170A. A unique aspect of the adapter 82 is that the diameter and wall thickness of the outlet 85 is designed so that it can accept a male fitting from a 1.250 (ID) vacuum hose or it can accept the actual 1.500 hose over the outside of the outlet 85. As discussed above, there could also be a relief vent/valve provided within the adapter 82 to relieve vacuum within the cover 170A, if necessary.

Figure 3:
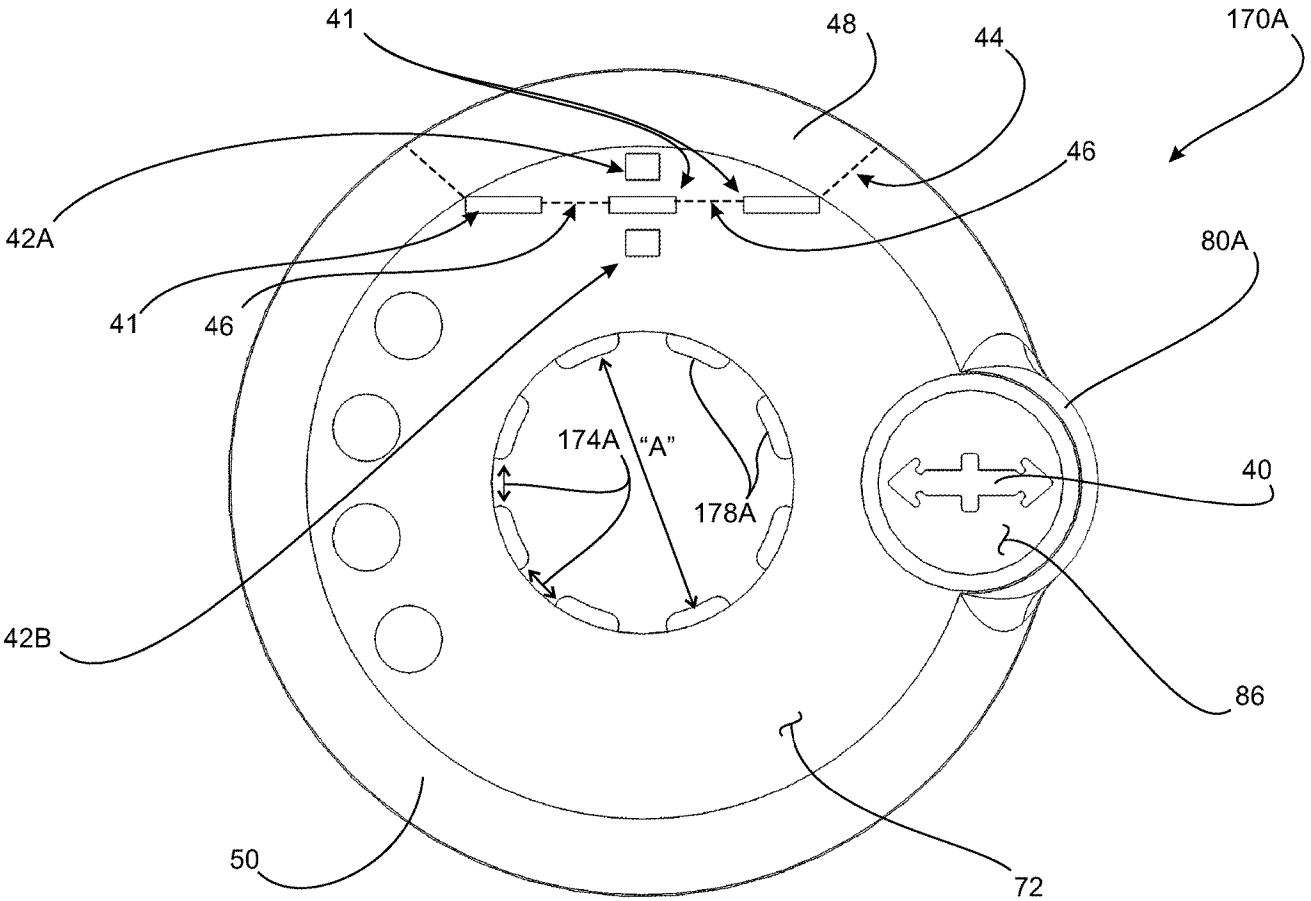
FIG. 3 is a top view of the cover of the shield of FIG. 2.

A series of plugs 73 are provided to the user. The plugs 73 can be selectively inserted into one or more of the air vents 75 when the door element [48] is opened. The vacuum source and amount of dust being created will determine whether and how many plugs 73 are used to plug air vents 75. FIG. 3 provides additional detail regarding the cover 170A.

FIG. 3 is a top view of the cover 170A of the shield [100A] of FIG. 2. The assembly is shown here as it would exit the mold in production. A peg element 40 is molded into the exhaust port 80A at the exit opening 86. This peg 40 is to be removed prior to the first use of the cover 170A; its purpose is to provide the user with the ability to hold open the door element 48 without using his or her hands. This feature is discussed in additional detail below.

As can be seen at the top of the cover 170A (in this depiction), an integral door element 48 is molded into the cover 170A. The door element 48 must be cut loose from the base 50 before it will open for zero clearance operations. There is a line of hinge apertures 41 that extend through the wall comprising the upper portion 72 of the base 50. The hinge apertures 41 are in spaced relation, and are separated by hinge elements 46, which are essentially strips of material molded into the upper portion 72 that are possibly somewhat thinner than the wall thickness of the rest of the upper portion 72. The dashed line shown at the outer edges of the outer hinge apertures 41 denotes a "cut line 44," along which the user must cut through the wall making up the upper portion 72 of the cover 170A so that the door element 48 can be opened for zero clearance operations.

There are also a pair of peg apertures 42A, 42B formed on either side of the door element 48 hinge (in this case centered on the middle hinge aperture 41). When the door element 48 is opened, the two peg apertures 42A, 42B will be in alignment so that the peg element 40 (once cut free from the exit opening 86) can be inserted through them to hold the door element 48 in the open position. The hinge [36] is discussed further below in connection with FIG. 3.

Figure 4:
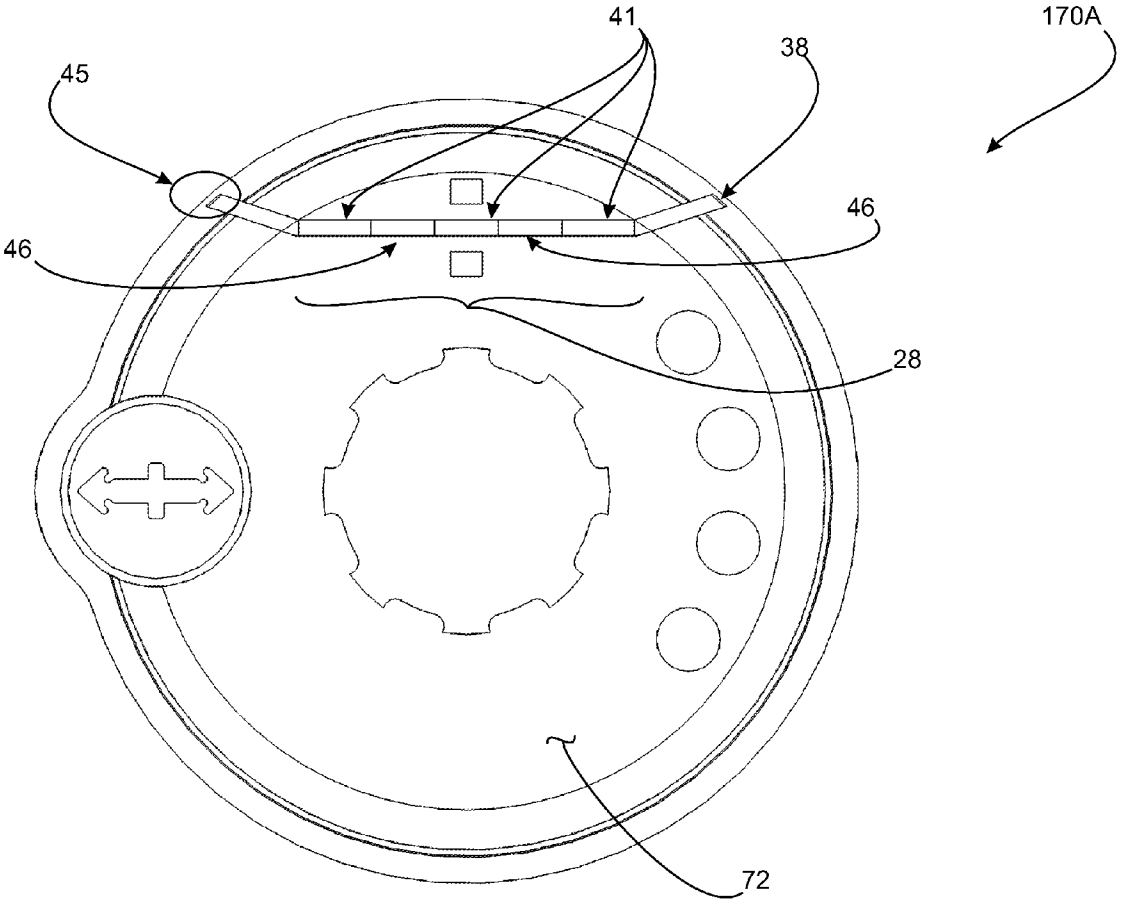
FIG. 4 is a bottom view of the cover of FIG. 3.
Figure 5:
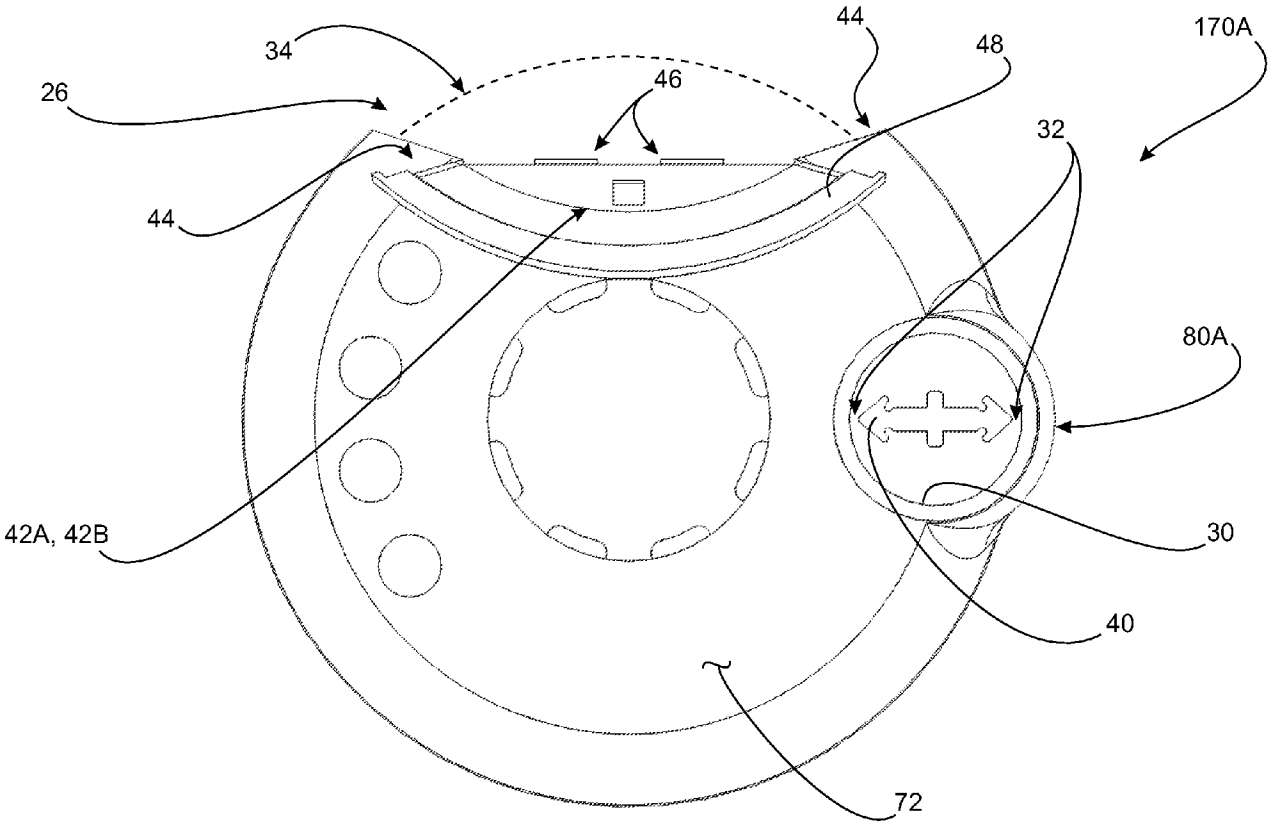
FIG. 5 is a top view of the cover of FIGS. 2 and 3 depicting the door element in the opened position.

FIG. 4 is a bottom view of the cover 170A of FIG. 3. From this bottom side, the portion of the upper portion 72 wall that is thinner than the rest can be seen. This thinner portion is created as a channel formed in the wall of the upper portion—it is referred to as the hinge channel 38. The hinge apertures 41 penetrate all the way through the upper portion, while the hinge elements 46 are not apertures, but rather are portions of the upper portion 72 that have a thinner wall thickness than the rest of the upper portion 72. The two outer segments of the hinge channel 38 correspond to the cut line [44] discussed above in connection with FIG. 3. Because of the channel 38, these portions thinner than the wall thickness of the rest of the cover 170A. The thin wall thickness is highlighted as element 45, but should be understood to be exemplary only—this element 45 simply identifies the hinge channel at a point where the thinner wall thickness is visible from below. FIG. 5 depicts the functionality of the cover 170A once the user has cut through the cover 170A along the cut line [44].

FIG. 5 is a top view of the cover 170A of FIGS. 2 and 3 depicting the door element 48 in the opened position. As shown, the door element 48 has been folded all the way open until it is flat against the top of the upper portion 72. In this position the cutting wheel 34 (depicted in hidden lines here) is exposed and is protruding through the cover opening 43 so that it can be used in a zero clearance 5 situation. Furthermore, the shroud 100A is designed so that when the door element 48 is in the up position, the edge of the grinding wheel, shown as a dotted line, is tangent to a line drawn between the points on the shroud 100A, 44-44. In this way, a minimal amount of dust is allowed to escape and the decreased aperture of the opening allows maximum suction.

The door element 48 has rotated around the hinge element 46 until the two peg apertures 42A, 42B are in alignment. The user need simply cut through the bridge elements 32 interconnecting the peg 40 with the wall 30 of the exhaust port 80A, and then insert the peg 40 through the peg apertures 42A, 42B in order to retain the door element 48 in the open position. An alternate view of this situation is shown in FIG. 6.

Figure 6:
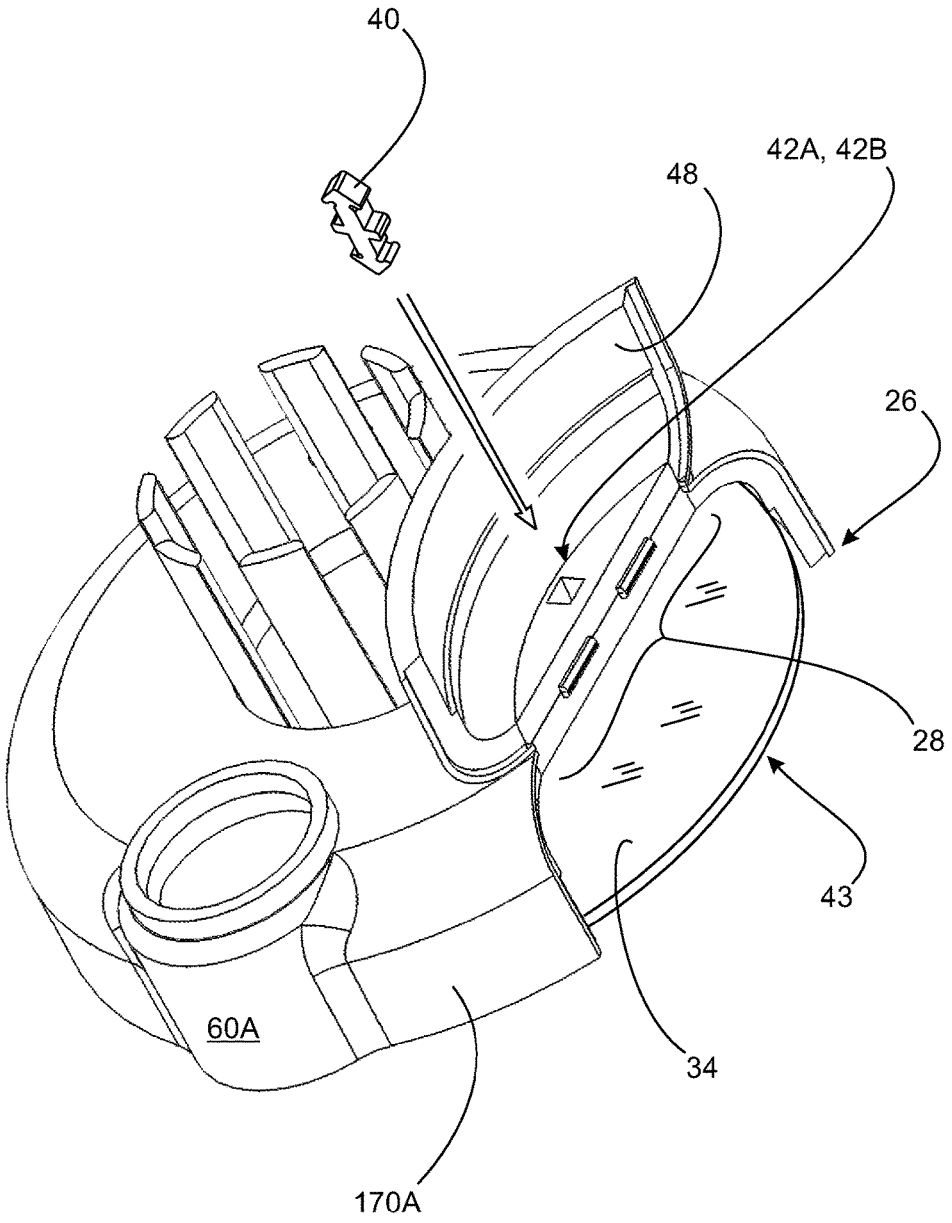
FIG. 6 is a perspective view of the cover of FIGS. 3-5 having the door element in the opened position.

FIG. 6 is a perspective view of the cover of FIGS. 3-5 having the door element 48 in the opened position. Here, the peg element 40 has been cut free from the exhaust port 80A, and is being inserted through the peg apertures 42A, 42B. If the user wishes to leave the door element 48 closed during use, he or she can remove the peg from the two apertures 42A, 42B and then pivot the door element 48 until it covers the side opening 26. The peg element 40 can then be stored by inserting it into either the aperture on the door element 42A, or the aperture on the upper portion 42B. In this manner, the peg element 40 is readily on hand when needed.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An adaptive dust shield for rotary grinders having a bearing housing with a groove therein, said adaptive dust shield comprising:

a cover having a defined diameter wherein said cover is adapted to encircle and cover a grinding disk attached to the rotary grinder, said cover defined by an upper face having a central aperture formed therethrough, said central aperture defining a width-X, wherein said Width-X is substantially less than said defined diameter;

a hose adapter pivotally extending from said upper face;

a plurality of upstanding flexible fingers in multiples of four on top of and around said central aperture, said plurality of upstanding flexible fingers having a Height H, and inside diameter of Width-A, and forming a broken circle around said upstanding flexible fingers wherein said Width-A is substantially less than said Width-X, said plurality of upstanding flexible fingers having a Width-W2 and being separated apart from each other defining a space between each one of said plurality of upstanding flexible fingers wherein said space has a Width-W1;

securing means for securing said upstanding flexible fingers onto the bearing housing of the grinder; and a stretchable fitting ring having an inside diameter, an outside diameter, an outer circumferential face, and a Height-E wherein said stretchable fitting ring is fit-able onto the bearing housing of the grinder and pressed into the groove as said securing means is applied and said plurality of upstanding fingers are pressed into engagement with said outer circumferential face of said stretchable fitting ring as said securing means is applied; and wherein:

said upper face comprises an exhaust aperture defining a wall terminating in a surface that is generally in a plane that is parallel to said upper face; and said hose adapter is an angled tube defined by a proximal end and a distal end, said proximal end defined by a barb formed in its periphery for engaging said exhaust aperture when said proximal end is inserted into said exhaust aperture such that said hose adapter is permitted to rotate relative to said exhaust aperture.

2. The dust shield of claim 1, wherein said upper face comprises a plurality of intake apertures formed therethrough, wherein one or more of said intake apertures has a removable plug element inserted therein.

3. The dust shield of claim 2, wherein said cover defines a generally circular shape, with a skirt portion extending downward from said upper face, said cover further comprising a side opening in adjacent portions of said upper face and said skirt portion.

4. The dust shield of claim 3, further comprising a door element configured to close said side opening.

5. The dust shield of claim 4, comprising a hinge interconnecting said door element and said cover.

6. The dust shield of claim 5, further comprising a prop element for restraining said door element in an open position.

7. The dust shield of claim 6, wherein:

said prop element comprises a pair of opposing barbed ends; and said cover and said door element are both defined by prop apertures formed therethrough whereby said prop apertures are juxtaposed when said door element is in an open position, and said prop apertures are cooperatively formed to accept said barbed ends therethrough.

8. A method of attaching a dust shield to a rotary grinder having a bearing housing with a surface area and a groove on said bearing housing comprising the steps of:

obtaining a dust shield having a cover with a top wall and a side wall, a plurality of upstanding fingers on said top wall, and an opening formed in a portion of said top and side walls, said opening closable by a door element pivotally attached to said top wall;

obtaining a stretchable fitting ring having an outside circumferential face, an inside circumferential face, a height as to cover a substantial portion of said surface area and being of a substantial thickness, and placing said stretchable fitting ring onto said bearing housing such that said inside circumferential face is in contact with said bearing housing;

placing said plurality of upstanding fingers around the outside circumferential face of said stretchable fitting ring; and placing a securing fastener around said plurality of upstanding fingers, either before or after placing said plurality of upstanding fingers around the outside circumferential face of said stretchable fitting ring, and tightening said securing fastener around said plurality of upstanding fingers and compressing said plurality of upstanding fingers onto said stretchable fitting ring and compressing said stretchable fitting ring onto said bearing housing.

9. The method claim 8, wherein said dust shield of said first obtaining step comprises a plurality of intake apertures formed through said top wall, wherein one or more of said intake apertures has a removable plug element inserted therein.

10. The method claim 9, wherein said dust shield of said first obtaining step comprises a prop element for restraining said door element in an open position.

11. The method claim 10, wherein said dust shield of said first obtaining step further comprises:

said prop element comprises a pair of opposing barbed ends; and said top wall and said door element are both defined by prop apertures formed therethrough whereby said prop apertures are juxtaposed when said door element is in an open position, and said prop apertures are cooperatively formed to accept said barbed ends therethrough.

12. The method claim 11, wherein said dust shield of said first obtaining step further comprises a hose adapter pivotally extending from said upper portion.

13. An adaptive dust shield for rotary grinders having a bearing housing with a groove therein, said adaptive dust shield comprising:

a cover having a defined diameter wherein said cover is adapted to encircle and cover a grinding disk attached to the rotary grinder, said cover defined by an upper portion, a sloped portion extending therefrom and a skirt portion extending from said sloped portion, said upper portion having a central aperture formed therethrough, said central aperture defining a width-X, wherein said Width-X is substantially less than said defined diameter, said cover further defined by an opening formed in a portion of said upper, slope and skirt portions, wherein said opening comprises a door element extending from said upper portion, said door element defining an open position and a closed position relative to said upper portion, wherein said zero-clearance opening is closed when said door element is in said closed position and said zero-clearance opening is open when said door element is in said open position;

a plurality of upstanding flexible fingers in multiples of four on top of and around said central aperture, said plurality of upstanding flexible fingers having a Height H, and inside diameter of Width-A, and forming a broken circle around said upstanding flexible fingers wherein said Width-A is substantially less than said Width-X, said plurality of upstanding flexible fingers having a Width-W2 and being separated apart from each other defining a space between each one of said plurality of upstanding flexible fingers wherein said space has a Width-W1;

securing means for securing said upstanding flexible fingers onto the bearing housing of the grinder; and a stretchable fitting ring having an inside diameter, an outside diameter, an outer circumferential face, and a Height-E wherein said stretchable fitting ring is fit-able onto the bearing housing of the grinder and pressed into the groove as said securing means is applied and said plurality of upstanding fingers are pressed into engagement with said outer circumferential face of said stretchable fitting ring as said securing means is applied.

14. The dust shield of claim 13, wherein said door element is hingeably attached to said upper portion.

15. The dust shield of claim 14, wherein said upper portion comprises a plurality of intake apertures formed therethrough, wherein one or more of said intake apertures has a removable plug element inserted therein.

16. The dust shield of claim 15, further comprising a prop element for restraining said door element in an open position.

17. The dust shield of claim 16, wherein:

said prop element comprises a pair of opposing barbed ends; and said upper portion and said door element are both defined by prop apertures formed therethrough whereby said prop apertures are juxtaposed when said door element is in an open position, and said prop apertures are cooperatively formed to accept said barbed ends therethrough.

18. The dust shield of claim 17, further comprising a hose adapter pivotally extending from said upper portion.

* * * * *